US010518917B2

(12) United States Patent
Mueller

(10) Patent No.: US 10,518,917 B2
(45) Date of Patent: Dec. 31, 2019

(54) CONTAINER LID LOADING APPARATUS

(71) Applicant: Robert Bosch GmbH, Stuttgart (DE)

(72) Inventor: Martin J. Mueller, Palm Harbor, FL (US)

(73) Assignee: Robert Bosch GmbH, Stuttgart (DE)

( * ) Notice: Subject to any disclaimer, the term of this patent is extended or adjusted under 35 U.S.C. 154(b) by 170 days.

(21) Appl. No.: 15/657,372

(22) Filed: Jul. 24, 2017

(65) Prior Publication Data

US 2018/0105301 A1 Apr. 19, 2018

Related U.S. Application Data

(60) Provisional application No. 62/409,749, filed on Oct. 18, 2016.

(51) Int. Cl.
*B65B 35/50* (2006.01)
*B65B 35/26* (2006.01)
(Continued)

(52) U.S. Cl.
CPC ..... *B65B 35/50* (2013.01); *B65B 35/26* (2013.01); *B65B 43/60* (2013.01); *B65B 35/46* (2013.01)

(58) Field of Classification Search
CPC ..... B65B 35/50; B65B 43/60; B65B 35/26; B65B 35/46; B65B 7/2807; B65B 5/067;
(Continued)

(56) References Cited

U.S. PATENT DOCUMENTS 3,350,842 A * 11/1967 Renish ..... B65B 7/2807 53/316
3,583,347 A * 6/1971 Whitten, Jr. ..... B65B 7/2807 413/46

(Continued)

FOREIGN PATENT DOCUMENTS

JP S58 95917 U 6/1983

OTHER PUBLICATIONS

International Search Report and Written Opinion dated Apr. 26, 2019.

*Primary Examiner* — Chelsea E Stinson
*Assistant Examiner* — Jacob A Smith
(74) *Attorney, Agent, or Firm* — Wood, Phillips, Katz, Clark & Mortimer

(57) ABSTRACT

The present invention is directed to an apparatus for loading stacks of container lids into an associated lid-applying apparatus, as typically found in a container filling facility. The apparatus includes a reciprocably movable carriage which is positioned generally above the lid-applying apparatus. The carriage can be positioned in a first, loading position, which is generally offset from the apparatus for convenient placement of the lid stacks by operators. The carriage can then be moved over the lid-applying apparatus to a second, unloading position. The carriage includes movable lid supports, which then open to release the lid stacks downwardly onto the lid-applying apparatus. In the preferred form, vertically movable lid cradles extend upwardly from the lid-applying apparatus, and receive the lid stacks from beneath carriage. The cradles then move downwardly, carrying the lid stacks downwardly, for transfer of the stacks onto the lid-applying apparatus.

8 Claims, 8 Drawing Sheets

(51) Int. Cl.
*B65B 43/60* (2006.01)
*B65B 35/46* (2006.01)

(58) Field of Classification Search
CPC ..... B65B 7/08; B65B 39/06; B65B 39/002; B65B 39/003; B65B 43/14; B67B 2201/06
USPC ..... 53/282, 458, 306, 307, 572, 287, 531, 53/532, 539, 543, 308, 309, 310, 311, 53/312; 221/11, 67, 68, 104
See application file for complete search history.

(56) References Cited

U.S. PATENT DOCUMENTS 3,835,619 A * 9/1974 Reisman ..... B65B 7/2807 53/138.2
3,938,675 A * 2/1976 Rees ..... B29C 65/00 414/789.6
4,691,501 A 9/1987 King
4,907,941 A * 3/1990 Focke ..... B65B 19/228 271/157
5,154,315 A * 10/1992 Dominico ..... B65B 7/2807 221/105
5,863,177 A * 1/1999 Carson ..... B65B 5/068 198/392
5,946,886 A * 9/1999 Bealer ..... B65B 7/2807 53/287
6,219,996 B1 * 4/2001 Searle ..... B65B 7/168 141/125
2004/0149539 A1 * 8/2004 De Raedt ..... G07D 3/14 194/302
2014/0215973 A1 * 8/2014 Hagelqvist ..... B65B 31/02 53/478

* cited by examiner

CONTAINER LID LOADING APPARATUS

CROSS-REFERENCE TO RELATED APPLICATIONS

This application claims priority of Provisional Ser. No. 62/409,749, filed Oct. 18, 2016, entitled "Container Lid Loading Apparatus", the disclosure of which is hereby incorporated by reference in its entirety.

FEDERALLY SPONSORED RESEARCH OR DEVELOPMENT

Not Applicable.

MICROFICHE/COPYRIGHT REFERENCE

Not Applicable.

TECHNICAL FIELD

The present invention relates generally to an apparatus for applying lids to associated containers, and more particularly to an apparatus for loading stacks of lids into an associated lid-applying apparatus.

BACKGROUND OF THE INVENTION

Automated equipment for filling individual containers with flowable food products such as margarine, yogurt, ice cream, dairy products, and the like typically includes machinery for dispensing containers and presenting them to filling devices, and thereafter applying lids to the containers. Such automated equipment typically includes a conveyor arrangement for moving the containers past suitable filling devices, with lids thereafter applied to the individual containers for effecting closing and sealing. Stacks of lids are typically provided from which individual lids are taken for subsequent application to respective ones of the containers. To this end, lid applying machinery is known by which stacks of lids are fed to lid-applying transfer mechanisms for applying each lid to a respective container The machinery for applying lids to the containers typically includes plural, parallel arrangements for holding stacks of the container lids. Such arrangements can include so-called spinners, which are arranged in parallel. Stacks of lids are positioned on adjacent ones of the spinners, with the rotating motion of the spinners advancing the stack of lids to the transfer mechanisms. This type of apparatus positions stacks of lids generally horizontally in a nonmoving state, with each stack spun at high speed on two rolls which act to orient the stack into a smooth running stack. Once this happens the stack will spin smoothly, allowing it to go through a stop gate, with individual lids pulled out with vacuum or shuttled with a coin type mechanism to an applicator.

Because the filling apparatus may have a number of filling lines in parallel, and because the lid-applying machinery may be positioned some distance above the floor of the filling facility, it can be difficult and time-consuming to continually replenish the lid-applying machinery with stacks of lids. Machinery which is wide may require that stacks of lids be placed on the machinery from opposite sides of the machine by workers. One of the reasons to use the automatic systems is that it is difficult to reach across many multiples of lanes on the filling machines to load the spinning/non-stackable lids. The spinners are located on the upper end of the machine so the operator already needs to be positioned up higher than the floor in most cases. The lids must drop down into position above the filled cups to be applied.

The sequence is as follows: the operator must grab a stack or take a sleeve from the corrugated shipping box. These sleeves or rows, which typically include quite a number (e.g., 100) of the lids are then let loose onto the spinning rods. For the most part, it is possible for an operator to load machines up to four lanes wide, with an average lid diameter. For example, one standard is a 409 lid with a center line of 4.5 to 6 inch on the cross pitch of machines. Exceeding four lanes of a machine this size, factories must either use one of an automated devices (centrifugal/vertical unscramblers), or must position operators (multiple) on both sides of the machine for loading. Undesirable increases in manpower and/or capital, and valuable factory floor space, are incurred.

The present invention facilitates placement of stacks of container lids on the lid-applying machinery. The present invention is particularly suited to above-described apparatus which "spins" the stack of lids for subsequent individual application to respective containers.

SUMMARY OF THE INVENTION

The present invention is directed to an apparatus for loading stacks of container lids into an associated lid-applying apparatus, as typically found in a container filling facility. The apparatus includes a reciprocably movable carriage which is positioned generally above the lid-applying apparatus. The carriage can be positioned in a first, loading position, which is generally offset from the apparatus for convenient placement of the lid stacks by operators. The carriage can then be moved over the lid-applying apparatus to a second, unloading position. The carriage includes movable lid supports, which then open to release the lid stacks downwardly onto the lid-applying apparatus. In the preferred form, vertically movable lid cradles extend upwardly from the lid-applying apparatus, and receive the lid stacks from beneath carriage. The cradles then move downwardly, carrying the lid stacks downwardly, for placement of the stacks on the lid-applying apparatus.

In accordance with the illustrated embodiment, the present apparatus is configured for loading container lids on a lid-applying apparatus having a plurality of parallel, lid-receiving members. The lid-receiving members may be the so-called spinners of the lid-applying machinery, which members act to spin and advance each stack toward a respective lid-transfer mechanism.

The loading apparatus includes a reciprocable carriage mounted for movement above the lid-receiving members of the lid-applying machine. The carriage is laterally movable transversely of the lid-receiving members between a first, loading position, and a second, unloading position, wherein the carriage is positioned generally above the lid-receiving members. In the first loading position, the carriage is generally offset from the machine to facilitate convenient manual placement of stacks of lids on the carriage by operating personnel.

Notably, the reciprocable carriage includes a spaced-apart plurality of lid supports oriented generally parallel to the lid-receiving members. The lid supports are each movable between a closed position and an opened position. In the closed position of the lid supports, the stacks of lids are held in position on the carriage, with the stacks being dropped or discharged from the carriage when the supports move to the opened position.

For loading stacks of lids onto the carriage, the carriage is positioned in its first, loading position, with the lid supports in the closed position thereof. One or more stacks of container lids can be manually placed in the carriage on the lid supports. The lid-applying machine, positioned generally beneath the carriage, may continue to operate during loading of stacks onto the carriage.

After stacks of lids have been placed on the carriage, the carriage is movable to second, unloading position thereof. This may be effected manually, or by a suitable actuator. In the second position, the carriage is positioned generally above the lid-receiving members of the applying machinery. In this position of the carriage, the lid supports of the carriage are moved to the opened position, whereby the stacks of container lids are discharged downwardly from the carriage, and are subsequently received on the lid-receiving members of the lid-applying apparatus for subsequent application to containers.

While the stacks of lids may be discharged solely by gravity, it is presently preferred that the stacks be mechanically lowered onto the lid-receiving members. To this end, the present apparatus preferably includes a plurality of vertically-movable stacked-lid cradles, wherein adjacent ones of the cradles are positioned on respective opposite sides of the lid-receiving members.

The stacked-lid cradles are vertically movable in unison between a raised position, in which the cradles project upwardly of the lid-receiving members, and a lowered positioned, generally beneath the lid-receiving members. The stacked-lid cradles are movable to the raised position for receiving stacks of lids from the carriage when the carriage is in its second, unloading position, and with the lid supports in the opened position thereof for discharging the stacks of lids from the carriage onto the cradles. Thereafter, the cradles are movable downwardly to the lowered position so that the stacks of lids are transferred from the cradles onto the lid-receiving members of the lid-applying machine.

In the illustrated embodiment, an actuation cam is provided for automatically opening the lid supports when the carriage is moved to its second, unloading position. The actuation cam is positioned adjacent to carriage for operation of the lid supports, with the actuation cam moving the lid supports from the closed position to the opened position when the carriage is moved into the second, unloading position. The stacked-lid cradles are preferably moved to their raised position before the carriage, having stacks of lids thereon, is moved to its second, unloading position. As the carriage is moved into its unloading position, the actuation cam operates to move the lid supports in unison, whereupon the stacks of lids move downwardly of the carriage and are received on the raised, stacked-lid cradles. The cradles are then lowered, with the stacks of lids thereon, to the lowered position generally beneath the lid-receiving members. The stacks are thus transferred onto the lid-receiving members of the lid-applying apparatus, and are advanced to the respective lid-applying mechanisms.

Other features and advantages of the present invention will be readily apparent from the following detailed description, the accompanying drawings, and the appended claims.

DETAILED DESCRIPTION

Figure 1:
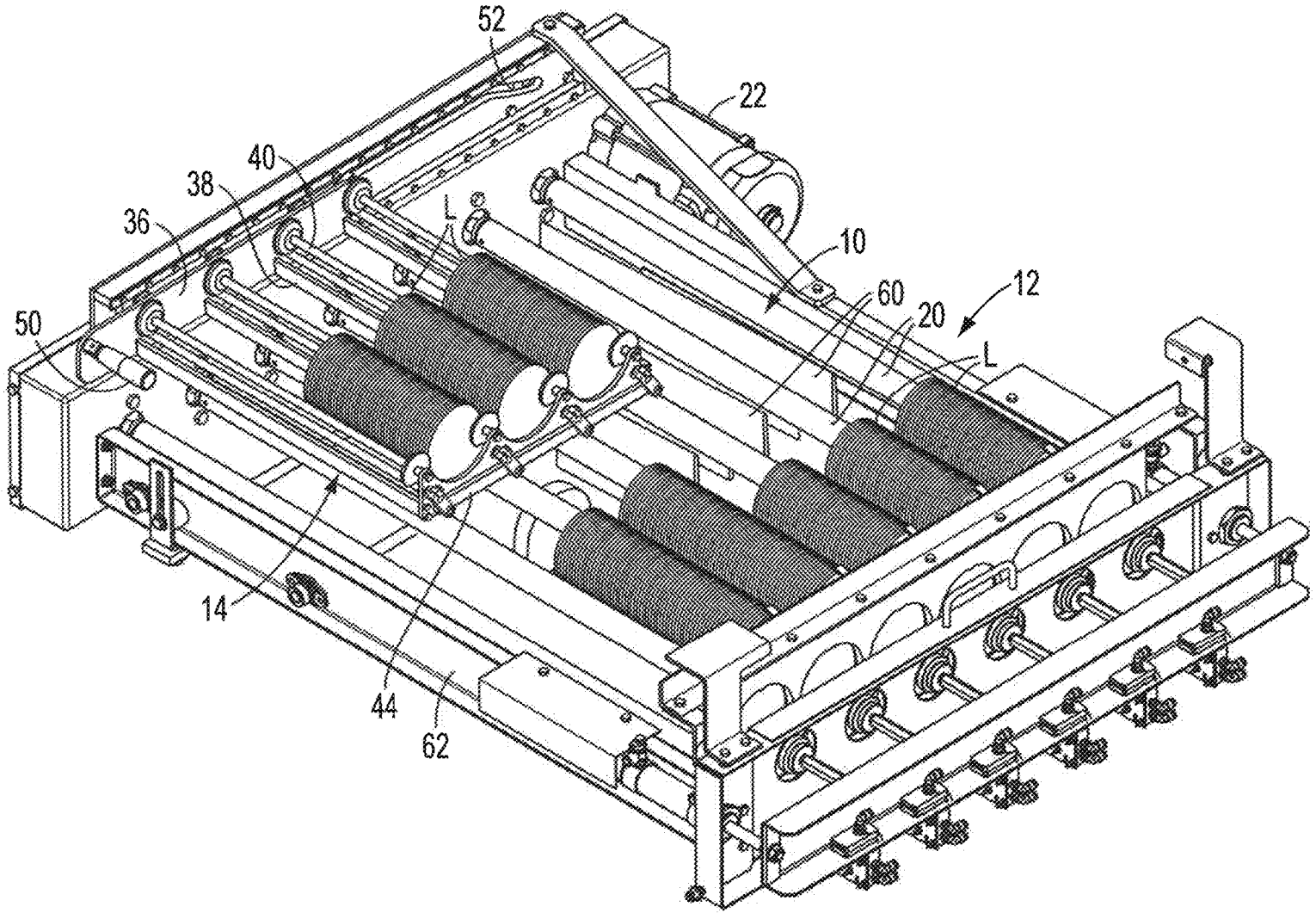
FIG. 1 is an isometric view of an apparatus, embodying the principles of the present invention, for loading stacks of container lids into an associated apparatus for applying the lids to individual containers.
Figure 2:
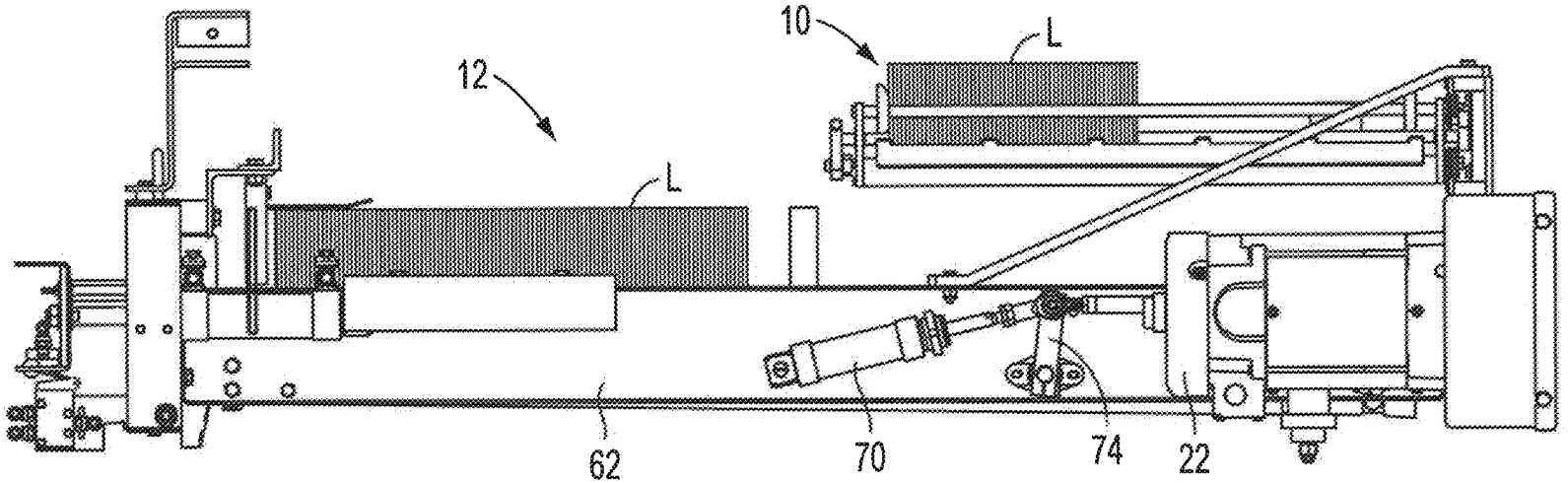
FIG. 2 is an opposite side elevation view of the loading apparatus shown in FIG. 1.

While the present invention is susceptible of embodiment in various forms, there is shown in the drawings and will hereinafter be described a presently preferred embodiment, with the understanding that the present disclosure is to be considered an exemplification of the invention, and is not intended to limit the invention to the specific embodiment which is illustrated.

As shown in FIG. 1, the present invention is directed to an apparatus, generally designated 10, for loading stacks of container lids L into an associated lid-applying apparatus, designated 12, as typically found in a container filling facility. The apparatus includes a reciprocably movable carriage 14 which is positioned generally above the lid-applying machine 12.

In accordance with the illustrated embodiment, the present apparatus is configured for loading container lids on a lid-applying machine having a plurality of parallel, lid-receiving members. The lid-receiving members may be the so-called spinners of the lid-applying machinery, which members act to spin and advance each stack toward a respective lid-transfer mechanism.

Figure 8:
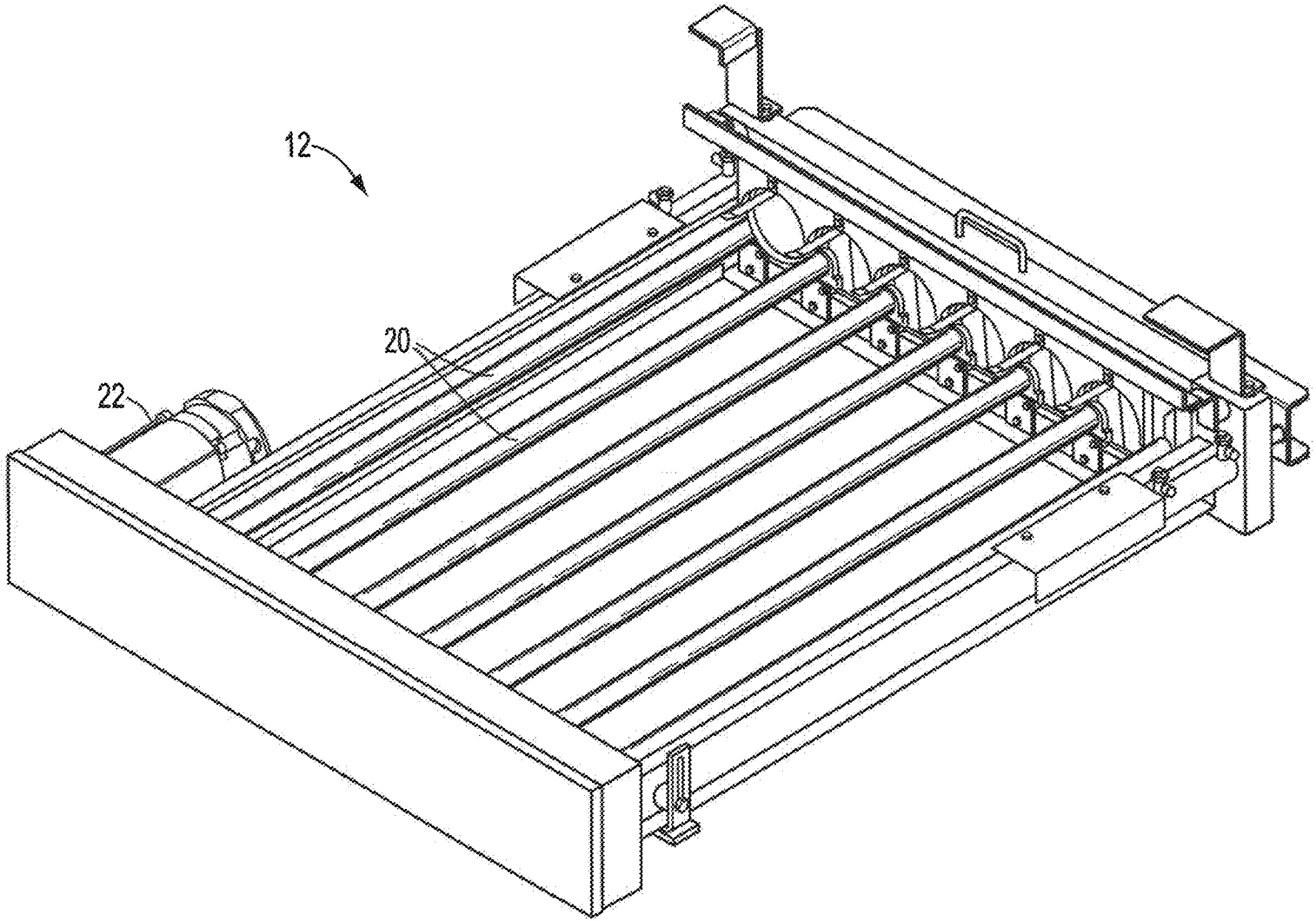
FIG. 8 is an isometric view of the lid-applying apparatus with which the present loading apparatus is configured for use.

FIG. 8 shows the lid-applying apparatus 12 with which the present lid loading apparatus is configured for use. As known in the art, apparatus 12 is configured for receiving stacks L of containers lids, and for removing and applying individual ones of the lids to associated containers, as typically effected in conjunction with filling of the containers, such as with flowable food product.

To this end, the applying apparatus 12 includes a plurality of parallel, lid-receiving members 20, spaced from each other along a first line, with each adjacent pair of the members 20 receiving a stack L of lids thereon. In a current embodiment, the lid-receiving members 20 are sometimes referred to as "spinners", in that each of the members is rotatably driven along its axis. Additionally, the members 20 can be arranged at angle or incline, by which the stacks L of lids tend to move by gravity toward the portion of the apparatus 12 that transfers the bottom-most lid from each stack for application to its respective container. The spinning motion of the members 20 acts to assist with the gravity-feed of the stacks L, ensuring that the stacks are urged into position for transfer of the bottom-most lid of each stack into position for application to a respective container. A drive motor 22 drives the members 20 in unison to advance the stacks L of lids along the apparatus.

As will be appreciated, efficient operation is promoted by operating the filling operation to advance plural containers in side-by-side arrays past the filling equipment and into position for receiving container lids from the applying apparatus 12. By way of example, it will be noted that the illustrated applying apparatus 12 is configured for applying lids to five such containers arranged in side-by-side relationship. In such an arrangement, an operator for the lid-applying apparatus is typically stationed at one side of the apparatus. Because each pair of lid-receiving members 20 of the apparatus 12 must be periodically replenished with another stack L of lids, efficient placement of stacks on those portions of the apparatus 12 can require undesirable stretching and manipulation.

Figure 3:
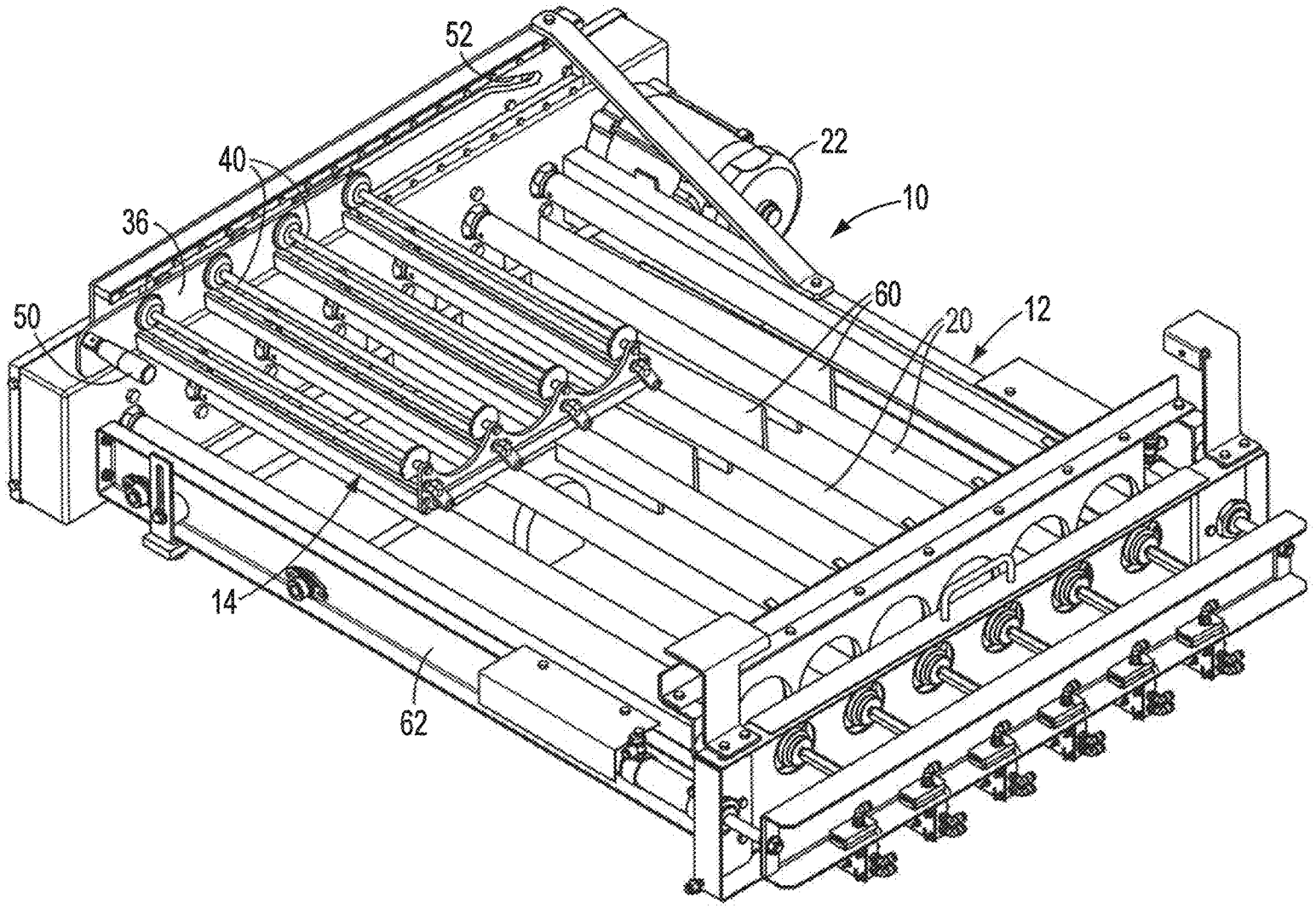
FIG. 3 is an isometric view similar to FIG. 1, shown without stacks of container lids, with the apparatus shown with a reciprocable carriage of the apparatus in a first, loading position for loading stacks of container lids onto the carriage.

To this end, the reciprocable carriage 14 of the loading apparatus 10 is positioned generally above the lid-applying apparatus, and can be efficiently accessed from one side of the applying apparatus 12. The carriage 14 can be positioned in a first, loading position, as shown in FIGS. 1 and 3, which is generally offset from the apparatus 12 for convenient placement of the lid stacks L by operators. The carriage 14 can then be moved over the lid-applying machine to a second, unloading position.

Figures 6, 6A:
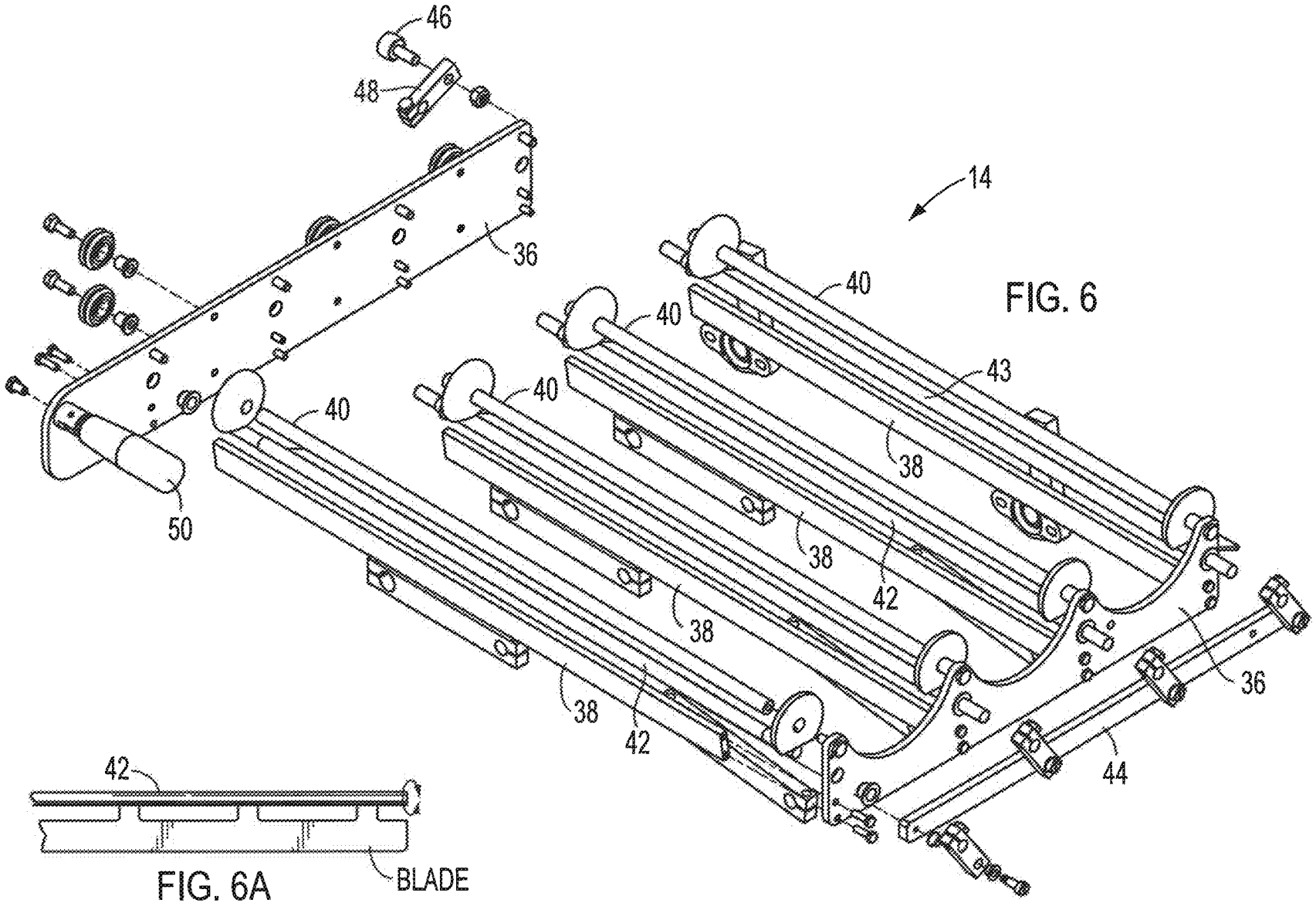
FIG. 6 is an exploded, isometric view showing the reciprocable carriage of the apparatus.
FIG. 6A is a side elevational view of one of the movable lid supports of the carriage of the apparatus.

As shown in FIG. 6, the carriage 14 includes a pair of end frame members 36, between which extent a plurality frame members 38. A plurality of stack guides 40 also extend between the end frame members 36, with stack of lids L being manually positionable between adjacent ones of the stack guides 40.

The carriage 14 is configured for receiving stacks of container lids, and thereafter transferring the stacks downwardly onto the lid-receiving members 20 of the lid applying apparatus. The carriage 14 thus includes a plurality of blade-like or paddle-like movable lid supports 42 (see FIG. 6A) arranged in a generally parallel relationship to the lid-receiving members 20 of the lid-applying apparatus 12. The lids supports 42 each include opposite end portions rotatably mounted in the end frame members 36, with a linkage 44 joined to the lid supports 42 so that they rotatably move in unison. Movement of the lid supports is effected by the provision of a cam follower 46, which is operatively connected to the linkage 44 by a link 48 joined to an end of a drive shaft 43 opposite the linkage 44. Thus, movement of the cam follower 46, as will be described, acts through link 48 and its associated drive shaft 43 to operate linkage 44 so that the lid supports move in unison.

The lid supports 42 are each movable between a closed position and an opened position. In the closed position of the lid supports 42, the lid supports are in a generally raised orientation, and the stacks of lids L are held in position on the carriage 14. The stacks are dropped or discharged from the carriage 14 when the supports 42 move and rotate generally downwardly to the opened position. This permits the stacks of lids to be released downwardly onto the lid-applying machine 12.

As noted, the reciprocable carriage 14 is mounted for movement above the lid-receiving members 20 of the lid-applying machine 12. The carriage 14 is laterally movable transversely of the lid-receiving members 20 between a first, loading position, and a second, unloading position, wherein the carriage is positioned generally above the lid-receiving members 20. In the first loading position, shown in FIGS. 1 and 3, the carriage 14 is generally offset from the lid-applying apparatus 14 to facilitate convenient manual placement of stacks of lids L on the carriage 14 by operating personnel.

For loading stacks of lids L onto the carriage 14, the carriage is positioned in its first, loading position, with the lid supports 42 in the closed position thereof. One or more stacks of container lids can be manually placed in the carriage on the lid supports 42. The lid-applying apparatus 12, positioned generally beneath the carriage 14, may continue to operate during loading of stacks L onto the carriage 14.

Figure 4:
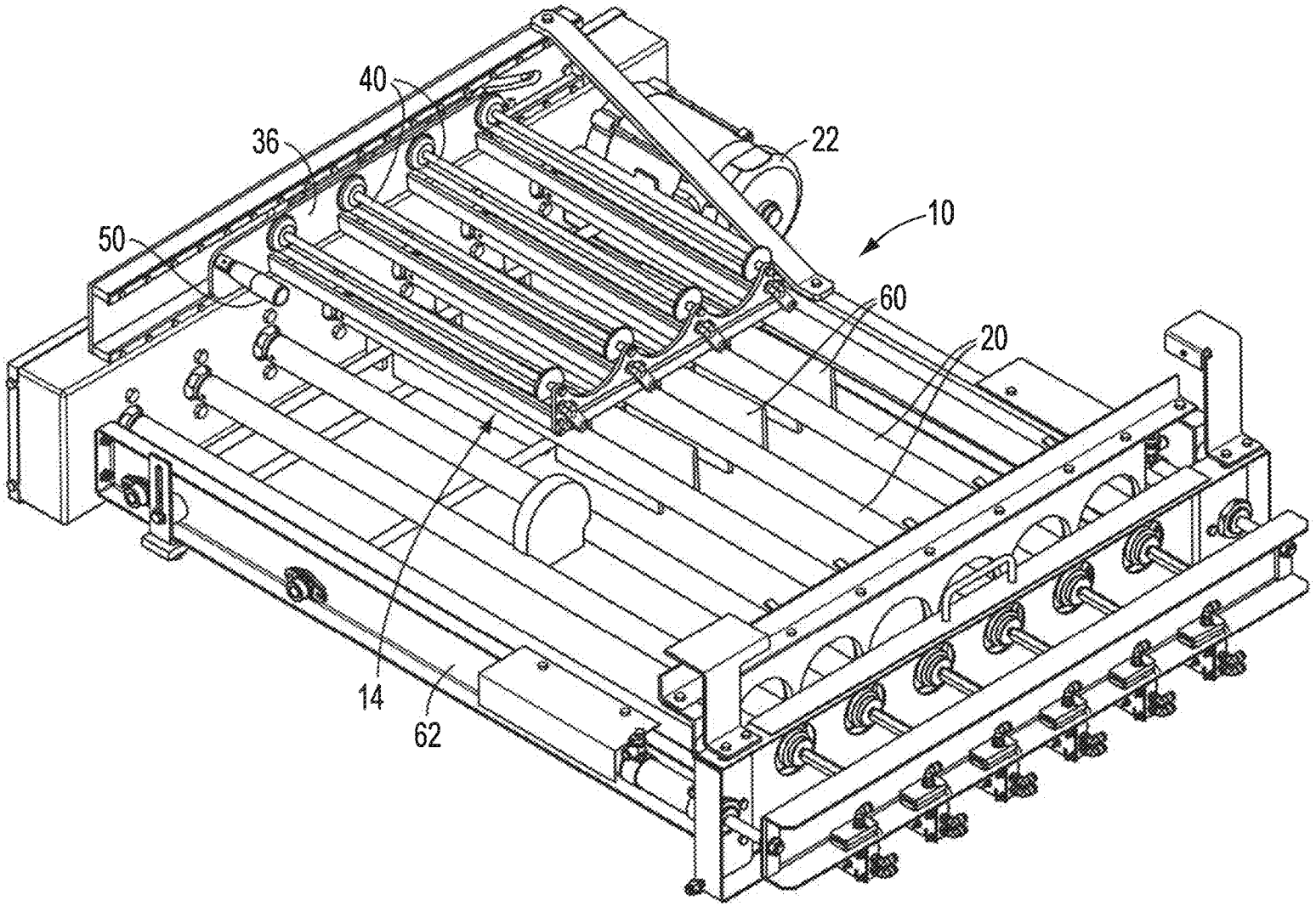
FIG. 4 is an isometric view similar to FIG. 3, with the reciprocable carriage of the apparatus in a second, unloading position for unloading stacks of container lids from the carriage.
Figure 5:
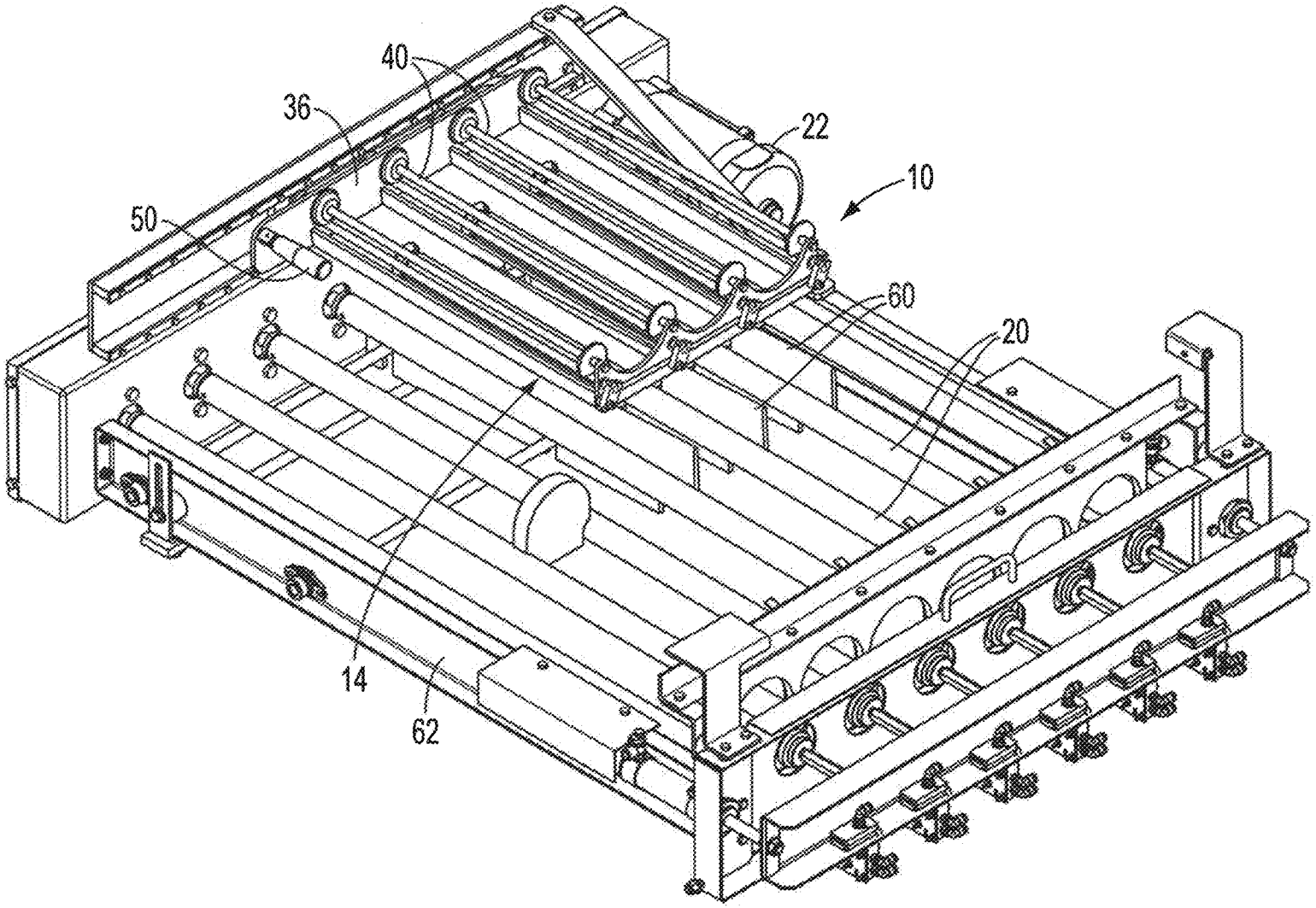
FIG. 5 is an isometric view similar to FIG. 4, with the reciprocable carriage of the apparatus in its second, unloading position, with movable lid supports on the carriage in an unloading position.

After stacks of lids L have been placed on the carriage 14, the carriage is thereafter movable to second, unloading position thereof. This may be effected manually, such as by manipulation of hand grip 50, or by a suitable actuator. In the second position, shown in FIGS. 4 and 5, the carriage 14 is positioned generally above the lid-receiving members 20 of the lid-applying apparatus. In this position of the carriage, the lid supports 42 of the carriage are moved to the opened position, whereby the stacks of container lids are discharged downwardly from the carriage by gravity, and are subsequently received on the lid-receiving members of the lid-applying apparatus for subsequent application to containers.

In the illustrated embodiment, a relatively fixed actuation cam 52 is provided for automatically opening the lid supports 42 when the carriage 14 is moved to its second, unloading position. The actuation cam 52 is positioned adjacent to carriage 14 for operation of the lid supports by movement of cam follower 46 as the carriage 14 is moved into its second, unloading position. The actuation cam 52, acting through cam follower 46, drive shaft 43, and linkage 44, acts to automatically rotate the lid supports 42 downwardly from the closed position to the opened position when the carriage 14 is moved into the second, unloading position.

While the stacks of lids L may be discharged solely by gravity, it is presently preferred that the stacks be at least partially mechanically lowered onto the lid-receiving members 20 of the lid-applying apparatus, which desirably acts to maintain the lids in the stacked arrays. To this end, the present apparatus preferably includes a plurality of vertically-movable stacked-lid cradles 60, wherein adjacent ones of the cradles 60 are positioned on respective opposite sides of the lid-receiving members 20.

Figure 7:
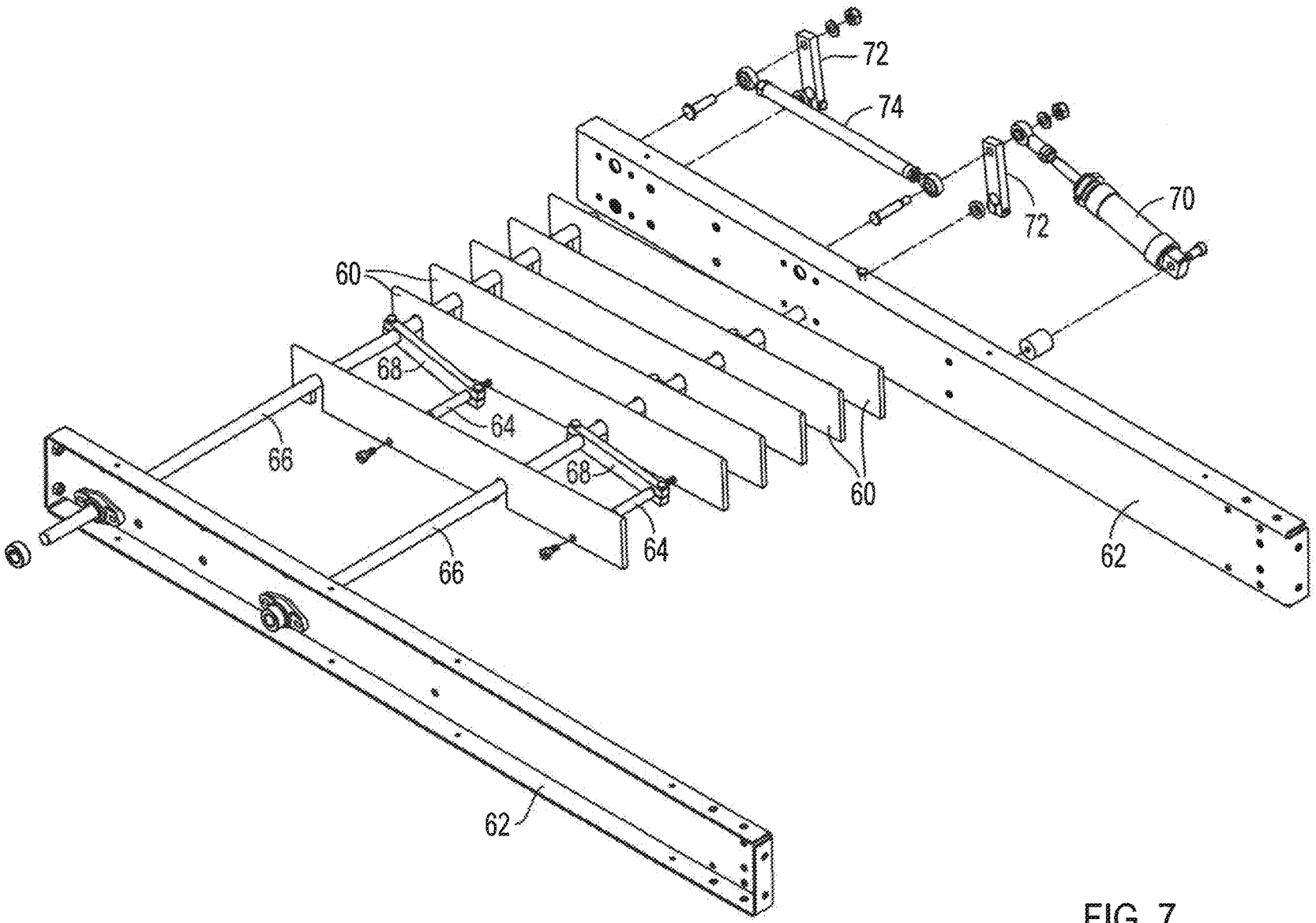
FIG. 7 is an exploded, isometric view showing the arrangement of vertically-movable, stacked-lid cradles of the apparatus.

FIG. 7 shows details of the arrangement of vertically moveable stacked-lid cradles 60. The blade-like cradles 60 are positioned between a pair of side frame members 62 which are integrated into the lid-applying apparatus 12. In the preferred form, the vertically movable stacked-lid cradles 60 extend upwardly from the members 20 lid-applying apparatus 12, and receive the lid stacks from beneath carriage 14. Cross members 64 (two being shown in FIG. 7) extend between adjacent ones of the cradles 60 to connect the cradles together for vertical movement in unison.

Vertical movement of the cradles 60 is effected by a pair of drive shafts 66 which are rotatably mounted on and extend between side frame members 62. A pair of drive links 68 respectively operatively connect the drive shafts 66 with the joined-together cradles 60, whereby rotational movement of the drive shafts acts to selectively raise and lower the cradles 60 in unison.

An actuator 70 mounted on one of the side frame members 62 is operatively connected to the drive shafts 66 by a pair of links 72 and linkage member 74, whereby reciprocable motion of the actuator 70 operates to reciprocably rotate drive shafts 66, thus acting to raise and lower the cradles 60.

The stacked-lid cradles 60 are vertically movable in unison between a raised position, in which the cradles project upwardly of the lid-receiving members 20, and a lowered positioned, generally beneath the lid-receiving members. The stacked-lid cradles 60 are movable to the raised position for receiving stacks of lids L from the carriage 14 when the carriage is in its second, unloading position, and with the lid supports 42 in the opened position thereof for discharging the stacks of lids from the carriage onto the cradles 60. Thereafter, the cradles 60 are movable downwardly to the lowered position by operation of actuator 70 so that the stacks of lids L are transferred from the cradles 60 onto the lid-receiving members 20 of the lid-applying apparatus 12.

The stacked-lid cradles 60 are preferably moved to their raised position before the carriage 14, having stacks of lids L thereon, is moved to its second, unloading position. As the carriage 14 is moved into its unloading position, the actuation cam 52 operates cam follower 46 to move and open the lid supports 42 in unison, whereupon the stacks of lids L are received on the raised stacked-lid cradles 60. The cradles 60 are then lowered, with the stacks of lids thereon, to the lowered position generally beneath the lid-receiving members 20. The stacks L are thus transferred onto the lid-receiving members 20 of the lid-applying apparatus, and are advanced to the respective lid-applying mechanisms.

Thus, the present invention is particularly suited for use with a lid-applying apparatus having lid-receiving spinners. It is contemplated that the reciprocable carriage of the apparatus can be configured as may be required for the specific lid-applying apparatus. For example, a three-stack carriage can be used for a six lane machine, and a four-stack carriage can be used for an eight-lane machine and, so on. If the lids are larger, even a two-stack carriage for a four-lane machine can be employed.

Notably, the present invention can be used with a standard spinning mechanism, with all the rollers and all the end stops with vacuum and or shuttle dispensers, leaving most of the unit standard. Additionally, the invention, including the reciprocable carriage, can be configured as a standard unit for a retro-fit to existing machinery. The carriage can be mounted to the top end of the spinning mechanism, above the spinning lids.

It is contemplated that the first, or front rows of lids should be loaded as they were before, previously by reaching over and loading rows 1, 2, 3, 4 as normal. The arrangement provides enough space, adjacent the carriage, for 1 1-2 to 2 stacks of the lids to be loaded in these first rows. Once these are loaded, the operator loads the carriage with the lids for the remaining rows, for example, rows 5, 6 or 5, 6, 7, 8. Once the carriage is loaded it is pushed forward into the machine, running parallel to the other stacks. Once it reaches the furthest point above the empty spinning rollers, the gates, i.e., lid-supports 42 of the carriage 14 are opened, and the lids drop down onto the spinning rollers.

The illustrated embodiment employs cam 52 and cam follower 46 to effect the opening of the lid supports 42, but different mechanisms can be used to release the lids. Once released they could drop directly onto the spin rollers below, but for improved efficiencies the vertically-movable cradles 60 will raise right before the release drops the lids, and they are gently transferred onto the cradles and the cradles then gently lowers the lids onto the spinning rollers where they orientate and spin and roll down to the release gate. The carriage 14 is positioned above the plane of the spinning rollers 20 so once the rollers have been loaded the carriage can be pull back again to load the next stacks. Automation can be applied with pneumatic cylinders or servos, but the most cost effective and safest way is to push the carriage 14 in and out by hand, with a pneumatic cylinder, i.e., actuator 70, for the cradles to raise and lower.

From the foregoing, it will be observed that numerous modifications and variations can be effected without departing from the true spirit and scope of the present invention. No limitation with respect to the specific embodiment illustrated herein is intended or should be inferred. The present disclosure is intended to cover, by the appended claims, all such modifications as fall within the scope of the claims.

The invention claimed is:

1. An apparatus for loading container lids on a lid-applying machine having a plurality of lid-receiving members that support accumulated lids in a plurality of stacks spaced from each other along a first line for subsequent application of the lids to containers, the apparatus comprising:

a reciprocable carriage mounted for movement between a first, loading position, and a second, unloading position, said carriage including a plurality of lid supports each being movable between a closed position and an opened position, wherein in said first, loading position of said carriage, and with said lid supports in the closed position, a plurality of spaced stacks of container lids are placed on said carriage, said carriage thereafter being movable to said second, unloading position, and said lid supports moved to said opened position, whereby first and second of said stacks of container lids are discharged from said carriage and are received on said lid-receiving members at first and second locations spaced along the first line to replenish existing stacks or define new stacks of lids on the lid-receiving member at the first and second locations.

2. An apparatus in accordance with claim 1, including a plurality of vertically-movable stacked-lid cradles, said stacked-lid cradles being vertically movable in unison between a raised position in which the cradles project upwardly of said lid-receiving members, and a lowered positioned generally beneath said lid-receiving members, said stacked-lid cradles being movable to said raised position for receiving stacks of lids from said carriage when said carriage is in said second, unloading position, and said lid supports are in said opened position for discharging the stacks of lids from said carriage to said stacked-lid cradles, said stacked-lid cradles thereafter being movable to said lowered position so that the stacks of lids are transferred from said stacked-lid cradles to said lid-receiving members.

3. An apparatus in accordance with claim 1, including an actuation cam positioned adjacent to said carriage for operation of said lid supports, said actuation cam moving said lid supports from said closed position to said opened position when said carriage is moved into said second, unloading position.

4. An apparatus in accordance with claim 3, wherein said carriage includes a linkage operatively connecting said plurality of lid supports for movement together, and a cam follower operatively connected to said linkage and engageable with said actuation cam for moving said lid supports in unison from said closed position to said opening position when said carriage is moved into said second, unloading position.

5. The apparatus in accordance with claim 1, wherein the plurality of lid supports each is movable from the closed position into the opened position as an incident of the carriage moving from the first, loading position into the second, unloading position.

6. The apparatus in accordance with claim 1, wherein with the carriage in the first, loading position and a plurality of spaced stacks of containers on the carriage, the plurality of spaced stacks of containers are above accumulated lids on the lid-receiving members.

7. An apparatus for loading container lids on a lid-applying machine having a plurality of lid-receiving members that support accumulated lids in a plurality of stacks spaced from each other along a first line for subsequent application of the lids to containers, the apparatus comprising:

a reciprocable carriage mounted for movement between a first, loading position, and a second, unloading position, said carriage including a spaced-apart plurality of lid supports each being movable between a closed position and an opened position, wherein in said first, loading position of said carriage, and with said lid supports in the closed position thereof, a plurality of spaced stacks of container lids are placed on said carriage, said carriage thereafter being movable to said second, unloading position, and said lid supports moved to said opened position, whereby first and second of said stacks of container lids are discharged from said carriage; and a plurality of vertically-movable stacked-lid cradles, said stacked-lid cradles being vertically movable in unison between a raised position in which the stacked-lid cradles project upwardly of said lid-receiving members, and a lowered positioned generally beneath said lid-receiving members, said stacked-lid cradles being movable to said raised position for receiving stacks of lids from said carriage when said carriage is in said second, unloading position, and said lid supports are in said opened position for discharging the stacks of lids from said carriage to said stacked-lid cradles, said stacked-lid cradles thereafter being movable to said lowered position so that the stacks of lids are transferred from said stacked-lid cradles to said lid-receiving members.

8. An apparatus in accordance with claim 7, including an actuation cam positioned adjacent to said carriage for operation of said lid supports, and a cam follower operatively connected to said plurality of lid supports and engageable with said actuation cam for moving said lid supports in unison from said closed position to said opening position when said carriage is moved into said second, unloading position, said actuation cam moving said lid supports from said closed position to said opened position when said carriage is moved into said second, unloading position.

* * * * *